United States Patent [19]

Graham et al.

[11] 4,188,355

[45] Feb. 12, 1980

[54] MANUFACTURE OF FIBROUS WEBS

[75] Inventors: Robert Graham, Chester-le-Street; Philip S. Hall, Langley Park, both of England

[73] Assignee: Newalls Insulation Company Limited, Manchester, England

[21] Appl. No.: 840,238

[22] Filed: Oct. 7, 1977

[30] Foreign Application Priority Data

Oct. 9, 1976 [GB] United Kingdom ..... 42064/76
Jun. 14, 1977 [GB] United Kingdom ..... 24835/77

[51] Int. Cl.[2] ..... B29D 27/04; D04H 1/68; H05B 9/04

[52] U.S. Cl. ..... 264/26; 264/46.2; 264/46.4; 264/50; 264/115; 264/DIG. 2; 425/4 C; 425/82.1; 425/83.1; 425/224

[58] Field of Search ..... 264/45.8, 45.3, 26, 264/46.4, 46.2, 115, 50, DIG. 2; 425/4 C, 80.1, 81.1, 82.1, 83.1, 224

[56] References Cited

U.S. PATENT DOCUMENTS

| | | | |
|---|---|---|---|
| 2,879,197 | 3/1959 | Muskat et al. | 264/45.3 X |
| 3,025,202 | 3/1962 | Morgan et al. | 264/45.3 |
| 3,050,427 | 8/1962 | Slayter et al. | 264/45.3 X |
| 3,271,485 | 9/1966 | Canfield | 264/26 |
| 3,395,201 | 7/1968 | Kalwaites | 264/45.3 |
| 3,737,488 | 6/1973 | Porter et al. | 264/26 |
| 3,759,775 | 9/1973 | Shepherd | 264/45.3 X |
| 3,821,337 | 6/1974 | Bunclark et al. | 264/26 |

*Primary Examiner*—Philip Anderson
*Attorney, Agent, or Firm*—Oblon, Fisher, Spivak, McClelland & Maier

[57] ABSTRACT

Bonded non-woven mineral fibre mat is made by a process including the steps of forming a foam from an aqueous solution or suspension of a binder, impregnating a non-woven mat with the foam and then selectively removing a major portion of the water from the mat prior to setting and/or curing the binder.

10 Claims, 2 Drawing Figures

MANUFACTURE OF FIBROUS WEBS

BACKGROUND OF THE INVENTION

1. Field of the Invention

The present invention relates to the manufacture of bonded non-woven fibrous mats, particularly comprised of glass fibres or mineral wool.

2. Description of the Art

Such mats can be made by forming an air-laid mat, for example, by subjecting streams of molten glass or rock to the action of hot gases in the form of steam/air jets and to mechanical attenuation, prior to collection on a foraminous receptor surface in a forming hood. They can also be made from continuous filaments or strands, either as such or after chopping into staple fibre form prior to deposition on a receptor surface. A binder is sprayed onto the mat during or after formation and is thereafter cured in situ by the action of heat to form a bonded mat. Phenolic and polyester resins are commonly used in such processes, although other binders may also be used. Hot air and/or radiant heat are generally used to set the binder, for example by curing the resin.

The binder spraying step tends to be rather haphazard. It frequently results in excessive local concentrations of binder, losses of binder into the atmosphere and consequent pollution problems. Because of the high temperature of the newly-formed fibres an the presence of the hot gases used to attenuate them, the binder has to be sprayed at a high water content (for example, 80–90% water, 10–20% binder), although in practice most of this water is lost by evaporation together with a significant proportion of the binder. The variations in the binder content throughout the mat may be considerable, for example, ±5% relative to a target binder content in the finished product of 10% by weight, which means that in general the level of binder addition must be appreciably higher than would be necessary if the distribution were sensibly even.

It has been proposed to make bonded non-woven fibrous mats by a process including the steps of forming a foam from a suspension/solution of the binder and impregnating a non-woven fibrous mat with the foam. In such a process the impregnation step is carried out by applying the foam as a layer on one face of the mat, the foam being squeezed into the mat by a roller, doctor blade or an endless belt, assisted by the application of suction at the opposite face of the mat. After impregnation, the binder may be caused to set in situ, for example, by heating, as mentioned above. However, the application of this process to glass fibre and/or mineral wool mats has proved difficult due to the very high porosity of such mats and the tendency of the binder to migrate on drying/curing. Furthermore, the application of a foamed binder to a newly-formed mat of hot fibres on a production line can result in premature and/or uneven setting/curing of the binder, before proper impregnation of the mat has been accomplished.

According to the present invention, a bonded non-woven glass fibre or mineral wool mat is made by a process including the steps of forming foam from an aqueous solution or suspension of a binder, impregnating a non-woven mat with the foam and then selectively removing a major portion of the water from the mat prior to setting/curing the binder.

Preferably the water is removed by the application of high frequency dielectric heating.

Preferably, the amount of foamed binder applied to the mat is in excess of that required to give the desired binder solids content in the final dry product, the extent of the excess being of the order of 50% or more by weight, and the surplus being drawn through the impregnated mat prior to selectively removing the water. Advantageously, the surplus is thereafter collected and re-circulated. Thermosettable resins are especially preferred as binders.

It has been found that the application of binder as an aqueous foam, particularly when applied in the excess just referred to gives significantly more uniform impregnation, typically of the order of ±1% of the target value as opposed to the relatively high variability experienced with prior art processes. This means that one can use less binder for a particular product density while maintaining substantially the same physical properties such as strength and rigidity. It also means that there can be a significant economy in binder consumption by virtue of the elimination of the conventional process step of spraying the binder into the forming hood mentioned earlier. Losses due to evaporation/-binder carry-over into the mat-forming hot gas streams through the foraminous receptor surface and the hot fibres are typically of the order of 15–30% and these losses can be eliminated for all practical purposes. With more efficient binder utilization there may also be enhanced fire resistance due to the reduced total organic content of the final product. The water content of the foam is determined by a number of factors such as the temperature of the mat and the final target binder content in the product. Because the foam contains water it can safely be applied even to a hot mat on a production line, provided that the water content is high enough to cool the mat and at the same time prevent significant curing/setting of the binder. However, it should be noted that even if the foam is applied to a hot mat, the water content of the impregnated mat (prior to selective removal of the major portion of the water) will be considerably higher than the water content of a similar bonded mat made by the traditional forming hood spraying process. For example, the latter process gives typical water contents of 4–6% (by weight), whereas the process of the present invention gives 10–30% water content. The use of a high water content and an excess of foam contributes not only to the uniformity of impregnation but also to maintaining that uniformity. The use of high frequency heating is particularly advantageous in this context since it enables the water to be removed from the whole thickness rather than from a single surface exposed to conventional heating. Effectively, high frequency heating dries the mat from the inside outwards to the surfaces. It also enables the mat to be dried to a controlled water content.

It has also been observed that high frequency heating causes a significant increase in the bulk of the mat, i.e. an increase in the thickness of the mat on selective removal of the water. The increase can be as much as three or four times the wet thickness of the mat immediately after impregnation. Although conventional drying methods do produce an increase in bulk, it has been observed that the increase caused by high frequency heating is usually greater. One result of this is that relatively low final dry densities of the order of 16 $Kg/m^3$ are possible. However, it is also possible to produce final densities of the order of 320 or more $Kg/m^3$ by compacting the dry mat prior to curing/setting the binder. The process of the present invention therefore exhibits a considerable degree of flexibility and enables the production of products over a wide range of final, dry density.

The process of the present invention is especially applicable to the production of mats of fibrous thermal insulation made from glass fibres, mineral wool or rockwool, where the binder is used to impart a degree of resilience and cohesion to the product without significantly reducing its porosity. The invention includes such products when made by a process according to the invention.

However, high frequency heating was previously thought impracticable in glass fibre/mineral wool manufacture because conventional binder application processes produce clots of binder in the mat and these react adversely to high frequency heating.

Using the process of the invention, it is also possible to impregnate a mat off the production line, which in some circumstances adds flexibility to the overall manufacturing process. In this particular case, the water content of the binder need not be as high as would be necessary for on-line application, because the mat would not normally need cooling. The binder and the water may be individually metered to give the mixture which is foamed. This is preferred because it makes for maximum control of the binder solids present in the final dry product and makes changes in binder solids very easy to effect.

While the high frequency heating is preferably applied only for as long as is necessary to selectively remove a major portion of the water, conventional heating being then used to set/cure the resin, it is also possible to use high frequency heating to set/cure the binder, before, during or after conferring a desired configuration on the mat. For example, a 6 to 12 second treatment can substantially dry a typical foam impregnated mat without significant effect on the binder. Where the binder is a thermosettable resin, a 20 second treatment would at least initiate curing of the resin. However, at production line speeds, such a long treatment time may be impracticable, or unduly expensive, or both.

Hitherto, the aplication of binder after mat formation has been difficult, if not entirely impracticable because of the desired bulky foraminous nature of the product. Uniform impregnation is not achieved by spraying binder onto the faces of an already-formed mat and the use of a liquid binder tends to destroy the desired bulk. For these reasons, shaped products such as lengths of tubular pipe insulation have always been made from mat impregnated with a settable/curable binder during production. Because it is no longer necessary to impregnate with binder during mat formation, it is now possible to make and store completely unimpregnated mat for future use, without having to worry about binder shelf life and/or variations in binder properties from batch to batch. This unimpregnated mat can be subsequently impregnated, dried and shaped into such products as lengths of tubular pipe insulation, prior to setting/curing the binder in the usual way. The invention includes products made in this way from unimpregnated mat. The present invention thus enables impregnation to be carried out at the most convenient time or location, thereby giving an essentially two-stage process in which mat formation and binder impregnation can be separated by any desired interval, with or without the optional step of also forming a shaped product from the impregnated mat.

A further advantage of high frequency heating lies in the fact that selective removal of water can be accomplished without producing significant binder fumes. The output airstream from the high frequency heater may even be vented to atmosphere without the usual effluent problems.

Advantageously, the aqueous binder solution/suspension contains a minor amount of a surfactant to facilitate foaming; the exact level of surfactant addition and the solids content (dilution) of a particular binder being a matter for experiment in order to arrive at a desired binder content in the final product.

A further advantage of the process of the invention is that excess foamed binder and any fibres therein can be re-circulated because the binder does not have to be sprayed and because it is still neither set nor cured.

The invention also includes apparatus for carrying out the process of the invention, said apparatus including a foam generator, means for spreading an aqueous foam made thereby onto one face of a non-woven mat, means operable to urge the foam into the mat together with heating means operable to selectively remove a major portion of the water from the impregnated mat. The heating means is preferably a high frequency heater. Preferably the apparatus further includes means for collecting and recirculating excess foam from the mat during and/or after impregnation thereof.

The means for urging the foam into the mat preferably includes both a suction device operative on the opposite face of the mat to that onto which the foam is spread and means for pressing the foam into the mat towards said suction device. Because glass/mineral wool mats are very porous, the means for pressing the foam into the mat should preferably seal against at least that face of the mat to which the foam is applied. Otherwise, the suction device may simply draw air through any relatively thin or more permeably parts of the mat without thoroughly impregnating them with the foam. Particularly preferred apparatus for this purpose comprises a foraminous roller containing at least one suction head and an impermeable endless flexible belt, one run of which presses against the mat as it passes over the roller. The roller is preferably in the form of a drum with peripheral, radially-extending flanges because the use of a drum and particularly one with sidewalls has been found to give a better seal between the flexible belt and the drum, thereby utilising the suction more efficiently. Where a high frequency heater is used to selectively remove water from the impregnated mat, it is preferably a radio frequency heater. Typically, such heaters operate at a frequency of approximately 27 mHz.

In order that the invention be better understood, preferred embodiments of it will now be described by way of example with reference to the accompanying drawing in which:

DETAILED DESCRIPTION OF THE PREFERRED EMBODIMENTS

Figure 1:
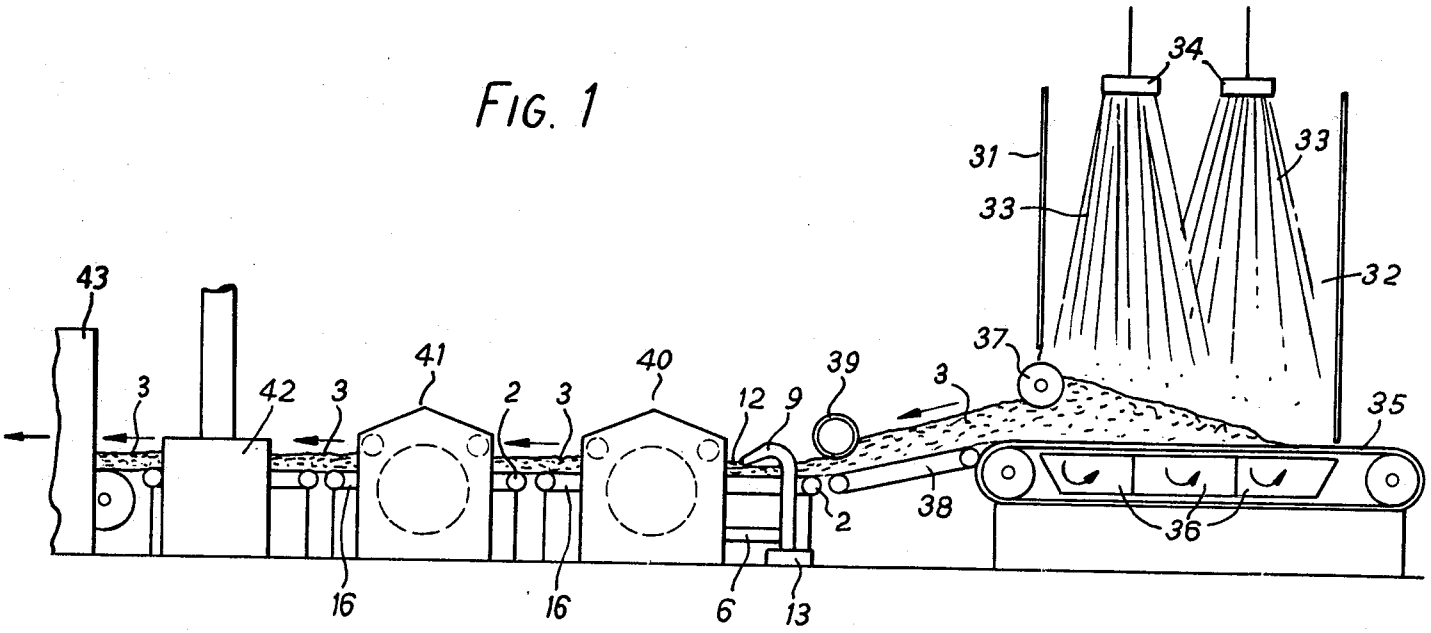
FIG. 1 is a partly schematic side view showing one apparatus for carrying out a process according to the invention.

Where practicable, common reference numerals are used in both figures.

Referring briefly to FIG. 1, this figure illustrates the application of the process and apparatus according to the invention to a glass mat production line.

In FIG. 1, a forming hood assembly 31 comprises a large chamber 32 into which two glass fibre streams 33 are projected from centrifugal spinning heads 34 supplied by a glass furnace (not shown). The glass fibres are received on a foraminous belt 35, the formation of a mat 3 being aided by suction heads 36 underneath the top run of the belt. The mat is compacted by a roller 37 and forwarded along an auxiliary conveyor 38, under a compacting roller 39 and fed into a foam impregnation apparatus 40 which will be described in detail later, with reference to FIG. 2.

This is followed immediately by a second FIG. 2 apparatus, designated 41, (but not fitted with a foam generator and delivery pipe, as will be discussed later). From the apparatus 41, the mat passes into a high frequency heating chamber 42 and thence into a curing oven 43, the initial portion only of which is shown. The apparatus 41 in this case serves only to remove surplus foam/liquid from the impregnated mat. The high frequency heating chamber 42 prepares the impregnated mat for the curing oven by selectively removing at least a major portion of the water from it and thereby drying the mat to a very appreciable and controlled extent, the latter depending of course on the size of the chamber, the power level applied and the speed of the conveyor, i.e. the production speed which determines the duration of the treatment applied by a particular heater.

It will be appreciated that FIG. 1 is purely illustrative and that much of the ancillary hardware has been omitted. However, for present purposes, it illustrates how a conventional mat production apparatus can be combined with foam impregnation apparatus and a high frequency heater.

The detailed construction of the apparatus 40 and 41 will now be explained with the aid of FIG. 2.

Figure 2:
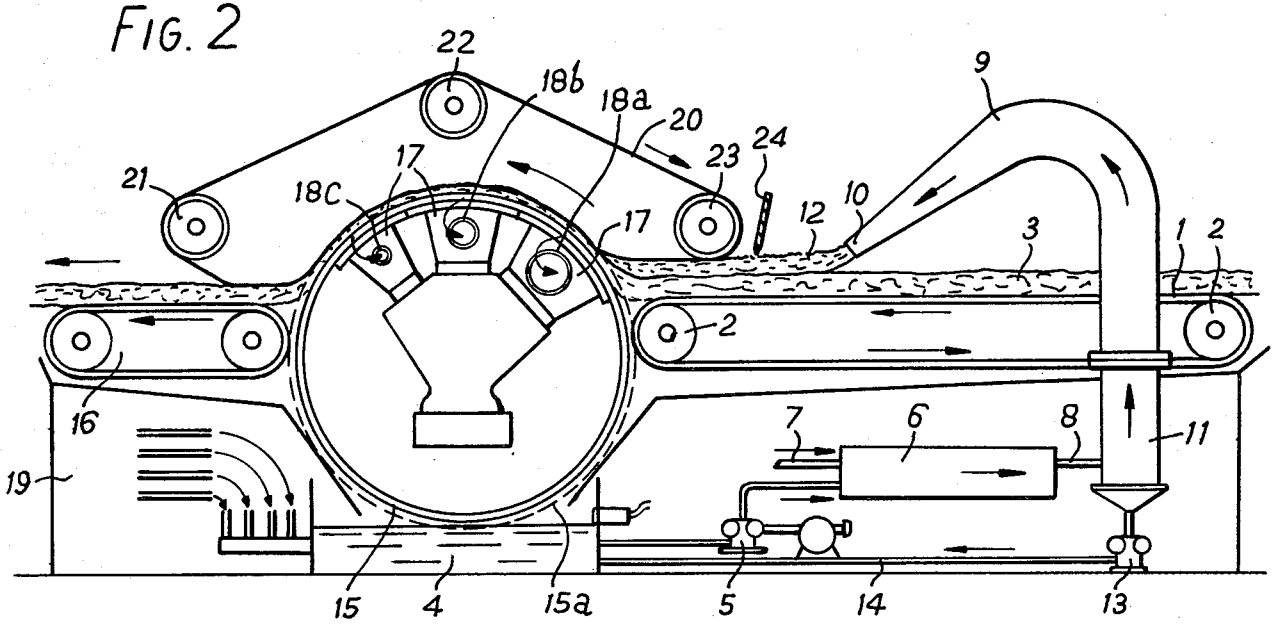
FIG. 2 is a partly schematic side view showing part of the apparatus of FIG. 1 in greater detail.

In FIG. 2, an endless belt 1 is mounted for recirculation around a pair of drive/support rollers 2. The direction of travel of the upper and lower runs of the belt are indicated by arrows and the upper run carries a glass fibre mat 3. A thermosettable resin solution tank 4 is located under the belt and resin is drawn from the tank by a pump 5 and fed to a foam generator 6, to which compressed air is also supplied by a pipe 7. The foam generator is conventional and comprises a column containing glass beads. The action of the generator is to form an intimate mixture of resin and air by constraining both to follow common, restricted paths through the medium inside the column. On leaving the column, the mixture expands into a foam. The foam outlet 8 from the column feeds a delivery pipe 9 which serves two purposes.

Firstly it delivers foam 12 to a slit nozzle 10 extending widthwise of the mat 3 and secondly it provides for the collection of unfoamed liquid in a recovery tube 11. Any liquid collected is returned to the tank for re-use, via a pump 13 and pipe 14.

The mat covered by a layer of foam, 12, is carried by the belt 1 under a doctor blade 24, towards and over a perforated drum 15, from which it passes along an auxiliary conveyor 16 to the high frequency heater of FIG. 1. The amount of foam applied is in excess of that required to give the desired binder solids content in the final, dry product, as discussed earlier. The extent of the excess is controlled by the depth of the layer of foam, 12, and this can be adjusted by, for example, changing the rate of foam production, or the speed of the belt 1, or the disposition of the doctor blade 24.

The perforated drum contains three stationary suction heads 17, respective axial outlet pipes 18*a*, 18*b*, 18*c*, each being connected toa vacuum source via a liquid resin trap, (none of which is shown, in the interests of simplicity). Any liquid recovered by the traps is returned to the tank through the pipes schematically illustrated at 19. The drum has radially-extending sidewalls of depth at least equal to the thickness of the mat to be impregnated, as indicated by dashed line 15*a*.

On the opposite side of the mat to the perforated drum an endless, impermeable flexible belt 20 is mounted for circulation around three support rollers 21, 22 and 23. The belt 20 is deliberately arranged to be somewhat slack so that its lower run can be progressively displaced under the influence of the suction applied to the underside of the mat. The result is that the belt 20 augments the suction and gradually presses the foam progressively into the mat until impregnation is completed. The belt and drum sidewalls co-operate to seal the mat against the drum surface.

It will be appreciated that the apparatus will normally be fitted with ancillary dispensing equipment for feeding liquid thermosettable resin solution an surfactant to the tank 4, although in the interests of simplicity this too has been omitted from the figure. It should also be noted that while the apparatus may form part of a complete production line including mat formation, resin curing and roll packaging operations, it may also be used to treat already-formed mats as a separate operation, as discussed earlier.

It should be noted in this latter context that while the resin will normally be cured on the production line, by means of hot air, and/or radiant heat, or by further high frequency heating, it is not essential to cure at this stage and, of course, it is not even necessary to impregnate and dry on the mat production line. The process of the invention can be applied to untreated mat at any time after production, thereby avoiding or minimizing processing problems resulting from the limited storage life of the thermosettable resins commonly used. In the particular context of a process involving a glass furnace, the ability to defer impregnation by any desired interval of time provides an at least partial solution to the problem of interruptions in production caused by the need to re-build the furnace when the refractory lining reaches the end of its useful life. Unimpregnated mat can be stored for use during such re-building.

The process may also be used to re-impregnate a mat, either with the same or a different resin, in the event that the initial impregnation was not satisfactory or a higher binder content is required.

The invention is also illustrated by the following examples.

EXAMPLE 1

An unimpregnated glass fibre mat was made by a centrifugal spinning process as described in relation to FIG. 1; the mat was one meter wide, 100 mm thick and weighed 700 gm/m$^2$.

An aqueous solution of a modified phenol-formaldehyde resin was made containing about 20% by weight of resin solids and 1% by weight (based on the resin solids) of a surfactant. This solution was foamed and applied to one face of the mat as a layer 50 mm deep, using an apparatus as shown in FIG. 2. The suction applied was 500 mm of mercury and the linear speed of the mat was 6 m/minute.

The impregnated, wet mat exhibited a total average pick-up of 18.2% by weight, of which 12.6% was water.

The wet mat was then exposed to radio frequency drying for 6 seconds by passing it through a radio frequency heater. The 6 second dwell time in the heater was sufficient to dry the mat to a 2% residual water content, without having any significant effect on the cure state of the resin. The dried, impregnated mat was passed through a hot air curing oven between two endless belts set 25 mm apart to give a 25mm thick board product of a density of 32 kg/m$^3$. The average cured resin solids content of the board was 5.4% by weight. The range of solids content measured was 4.8 to 5.7% by weight.

EXAMPLE 2

A similar unimpregnated mat to that of Example 1 was made and a foamed resin binder applied to it in exactly the same way, the only difference being that the initial solids content of the resin solution was 40% by weight instead of 20%.

The average pick-up of the wet mat was 45.2% by weight, of which 30.1% was water.

The radio frequency drying treatment was applied in this case for 13 seconds, which was sufficient to give virtually zero residual water content.

The dried, impregnated product was cut to size and pressed in a heated platen press into liner panels of asymmetrical thickness for automotive use, the thickness of each panel varying from 12 mm at one end to 2 mm at the other.

The temperature and duration of the pressing operation was sufficient to cure the resin, giving an average cured resin solids content of 14.6% by weight, the lower and upper departures from this average being 13.8 and 15.2% respectively. The density of the product was 68 kg/m$^3$ (at the 12 mm thickness) and 408 kg/m$^3$ (at the 2 mm thickness).

EXAMPLE 3

The procedure of Example 1 was followed, but with a mat of weight 350 gm/m$^2$ and thickness 50 mm. To this was applied the same foamed resin solution as in Example 1, but the linear speed of the mat was 12 m/minute and the suction was reduced to 250 mm of mercury.

The average pick-up of the wet, impregnated mat was in the range 23.1 to 25.3% by weight, with a water content of 16.1 to 16.9%.

This mat was then dried to 2% residual water content, an 8 second radio frequency heating treatment being required for this. Successive 1.5 meter lengths of the dried, impregnated mat were then formed into lengths of tubular pipe insulation prior to oven curing the resin with hot air. The final products were 915 mm long (one yard nominal length) and had a wall thickness of 25 mm at a bore size of 100 mm; they had a density of 55.4 kg/m$^3$ at an average cured resin solids content of 7.4%, the maximum lower and upper departures from this being 6.6 and 7.9%, respectively.

All of the foregoing Examples illustrate the application of the process of the invention to the manufacture of insulation products from already-prepared and unimpregnated mat, since no attempt was made to integrate the mat production and impregnation processes, the mat being made and stored in the unimpregnated state until it was convenient to subject it to impregnation. In fact, the storage period could have been of indefinite duration, because until the resin solution is applied to the mat there is no problem as to the shelf life of the mat. While all the Examples given above were carried out using a laboratory-type radio frequency heater rated at 1½ KW (at a frequency of 27 mHz), the actual power needed for a particular drying operation will naturally vary according to the desired throughput and the water content of the mat. The choice of an appropriate size of heater for any particular conditions will be within the capability of those skilled in the art.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A process for the production of a bonded, foraminous non-woven mineral fiber mat, said process comprising the following steps, in combination:

forming a non-woven mineral fiber mat by a melt spinning process, forming a binder foam from thermosettable binder composition in an aqueous medium, applying a layer of said binder foam to one face of said mat, forcing said layer into said mat, such that the binder foam is caused to collapse so as to thoroughly impregnate the entire mat with said collapsed binder foam, selectively removing by radio frequency heating a major portion of the aqueous medium from the impregnated mat, and thereafter causing the binder to set in situ in the mat.

2. A process according to claim 1 wherein high frequency heating is used to set the binder.

3. A process according to claim 1 which further comprises applying the foamed binder to said one face of the mat in excess of the amount required to give a desired solids content in the final dry product, drawing off said excess from the face of the mat opposite said one face thereof prior to said step of selectively removing the major portion of the aqueous medium from the mat, and collecting said drawn-off excess for re-circulation of the foam-forming step.

4. A process according to claim 1, which further comprises applying the foam binder to the mat in excess of the amount required to give a desired binder solid content in the final dry product and drawing off said excess prior to said step of selectively removing a major portion of the aqueous medium from the mat.

5. A process according to claim 4 wherein said excess is of the order of at least about 50% by weight.

6. Apparatus for the treatment of a non-woven mineral fiber mat, said apparatus comprising means for generating a binder foam from a thermosettable binder composition in an aqueous medium, means for applying said foam as a layer to one face of said mat, means for forcing said layer into the mat such that the binder foam is caused to collapse and the entire mat is thoroughly impregnated with said collapsed binder foam, and radio frequency heating means operable to selectively remove a major portion of the aqueous medium from the impregnated mat.

7. Apparatus according to claim 6, further including means operable to draw off and collect excess binder from the face of the mat opposite said one face thereof.

8. Apparatus according to claim 7, further including means for recirculating collected excess binder to the foam generating means.

9. Apparatus according to claim 6, further including means for forcing the binder foam into the mat while maintaining a seal against at least said one face.

10. Apparatus according to claim 9, wherein said means for forcing the binder foam into the mat comprises an endless, flexible impermeable belt and a cooperating foraminous drum containing a suction head and having radially-extending sidewalls for engaging marginal edge portions of said mat.

* * * * *